US006418762B1

(12) United States Patent
Münch et al.

(10) Patent No.: US 6,418,762 B1
(45) Date of Patent: Jul. 16, 2002

(54) SWITCHGEAR CABINET CLOSING DEVICE

(75) Inventors: Udo Münch, Sinn; Wolfgang Reuter, Burbach, both of (DE)

(73) Assignee: Rittal-Werk Rudolf Loh GmbH & Co., KG, Herborn (DE)

( * ) Notice: Subject to any disclaimer, the term of this patent is extended or adjusted under 35 U.S.C. 154(b) by 0 days.

(21) Appl. No.: 09/600,619

(22) PCT Filed: Dec. 10, 1998

(86) PCT No.: PCT/EP98/08032

§ 371 (c)(1),
(2), (4) Date: Jul. 19, 2000

(87) PCT Pub. No.: WO99/36649

PCT Pub. Date: Jul. 22, 1999

(30) Foreign Application Priority Data

Jan. 19, 1998 (DE) ..... 198 01 719

(51) Int. Cl.[7] ..... E05B 13/10

(52) U.S. Cl. ..... 70/208; 70/158; 70/254; 70/255; 312/216; 312/217

(58) Field of Search ..... 70/158, 208, 254, 70/255, 197, 160, 161, 162, 163, 164, DIG. 30; 312/217, 216, 218, 219

(56) References Cited

U.S. PATENT DOCUMENTS 5,457,971 A * 10/1995 Yamada ..... 70/208
5,685,181 A * 11/1997 Ramsauer ..... 70/208

* cited by examiner

*Primary Examiner*—William A. Cuchlinski, Jr.
*Assistant Examiner*—Marthe Y. Marc-Coleman
(74) *Attorney, Agent, or Firm*—Pauley Petersen Kinne & Erickson

(57) ABSTRACT

A switchgear cabinet closing device for locking a cabinet door on a switchgear cabinet. The closing device has a handle on which a closing mechanism is connected via an adjusting mechanism, whereby the handle is held on a housing mounted on an outer side of the cabinet door, and whereby the handle is secured in the lock position by a closing device. In order to adapt such a switchgear cabinet closing device to various closing systems in a simple manner, the housing has a primary housing for mounting the handle such that it can pivot, and a collar housing which can be connected to the primary housing. This invention also provides a collar housing that accommodates a lock of the closing mechanism.

10 Claims, 3 Drawing Sheets

SWITCHGEAR CABINET CLOSING DEVICE

BACKGROUND OF THE INVENTION

1. Field of the Invention

This invention relates to a switchgear cabinet locking device for locking a cabinet door of a switchgear cabinet, having a handle, to which a locking mechanism is connected via an actuating mechanism, wherein the handle is held on a housing attached to an exterior of the cabinet door, and wherein the handle is secured in a blocked position by a locking device.

2. Description of Related Art

Such a lock is known from U.S. Pat. No. 5,481,889. In this case the housing held on the cabinet door is shaped so that it simultaneously forms the handle. It has a receptacle, in which a cylinder lock is exchangeably housed. The housing can be fastened on an actuating mechanism embodied as a pinion shaft. The pinion shaft is passed through the cabinet door and connected to a locking mechanism on the back of the cabinet door.

Users which employ several switchgear cabinets are demanding, in larger numbers, that all switchgear cabinets should be opened with a single key. Large companies in particular use special keys for this purpose.

SUMMARY OF THE INVENTION

It is one object of this invention to provide a switchgear cabinet locking device of the type mentioned above but which permits refitting to different locking systems, in a simple manner.

This object is attained with a base housing, together with the attachment housing, forming a handle recess, in which the handle is housed in a locked position.

It is preferred that the lock is received exchangeably in the attachment housing, so that the lock can be used for a group of locks.

In one preferred embodiment of this invention the lock is held in an adapter element, which can be connected with the attachment housing. The adapter element has a standardized mechanical interface, into which different configurations of locks can be inserted. Thus the attachment housing can be adapted to geometrically differently designed locks by the adapter element. In one embodiment of this invention the lock has a transfer device, which transfers actuating movement of the lock to a linearly displaceable transmission element, which actuates a bolt for blocking the handle. In the closed position the bolt fixes the handle on the base, or respectively the attachment housing.

Any arbitrary locks, for example a cylinder lock or a pushbutton lock, can be held in the attachment housing.

In accordance with one embodiment of this invention, the handle is pivotal in a direction vertical with respect to the plane formed by the cabinet door, and in the pivoted-in position is blocked in the pivot direction by the lock in order to prevent an unauthorized opening. Furthermore, the handle can also be kept interlockingly transverse to the pivot direction on the base housing, so that it cannot be moved laterally out of the handle recess by force.

BRIEF DESCRIPTION OF THE DRAWINGS

This invention will be explained in greater detail in what follows by means of preferred embodiments shown in the drawings, wherein.

DESCRIPTION OF PREFERRED EMBODIMENTS

Figure 1:
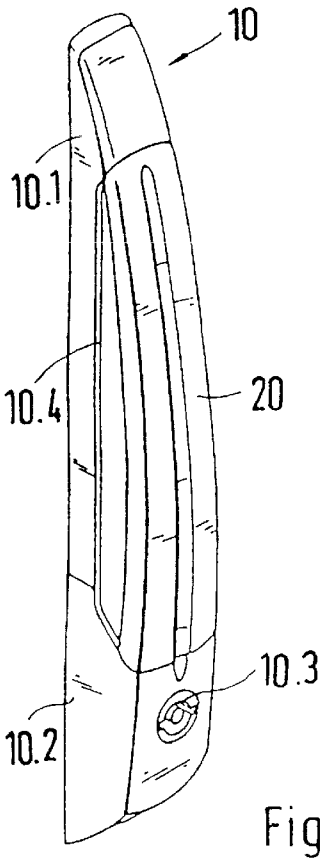
FIG. 1 is a perspective side view of a sliding rod locking device with the handle in a pivoted in position.

A switchboard cabinet locking device designed as a sliding rod locking device, which has a housing 10 with a handle recess 10.4, is shown in FIG. 1. The housing 10 comprises two parts, including a base housing 10.1 and an attachment housing 10.2. With the attachment housing 10.2 installed, the base housing 10.1 and the attachment housing 10.2 together form the handle recess 10.4. A handle 20 is housed in the handle recess 10.4.

FIG. 1 shows that in its pivoted-in position the handle 20 is received with its surface flush with the housing 10. The attachment housing 10.2 receives a lock 10.3.

Figure 2:
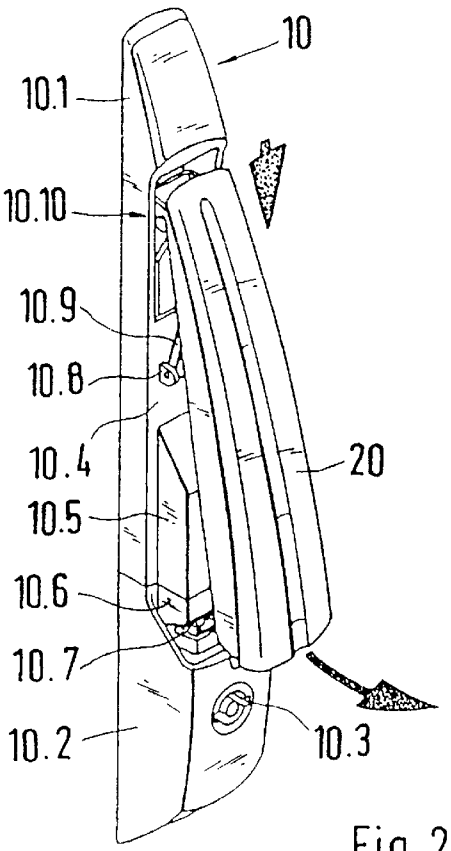
FIG. 2 is a perspective side view of the sliding rod locking device in accordance with FIG. 1 but with the handle in a partially pivoted out position.

A sliding rod locking device in accordance with FIG. 1 is shown in FIG. 2, wherein the handle 10 is partially pivoted out of the handle recess 10.4. It can be seen that the handle 20 is connected with the housing 10 via an actuating mechanism 10.10. The functioning of the actuating mechanism 10.10 is explained later, making reference to FIG. 4.

A bolt 10.7, housed in a bolt receptacle 10.6, is used for fixing the handle 20 in place in the pivoted-in position. On its outer contour, the bolt receptacle 10.6 has centering devices 10.5, on which a handle 20 is laterally stabilized in the pivoted in position. It is thus assured that the handle 20 cannot be laterally bent off by force.

Figure 3:
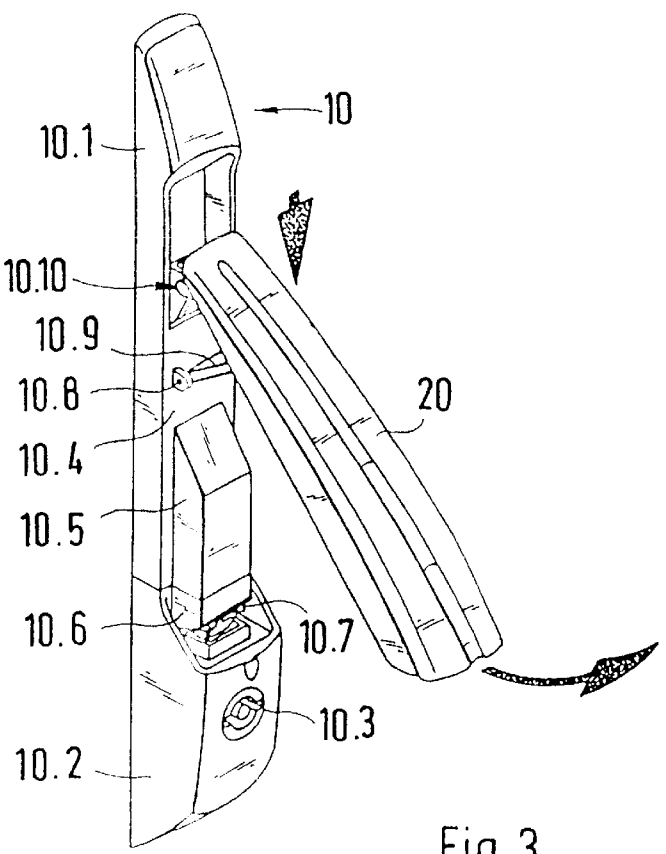
FIG. 3 is a perspective side view of the sliding rod locking device in accordance with FIGS. 1 and 2 but with the handle in a completely pivoted out position.

The sliding rod locking device is shown in the completely pivoted-out position in FIG. 3.

Figure 4:
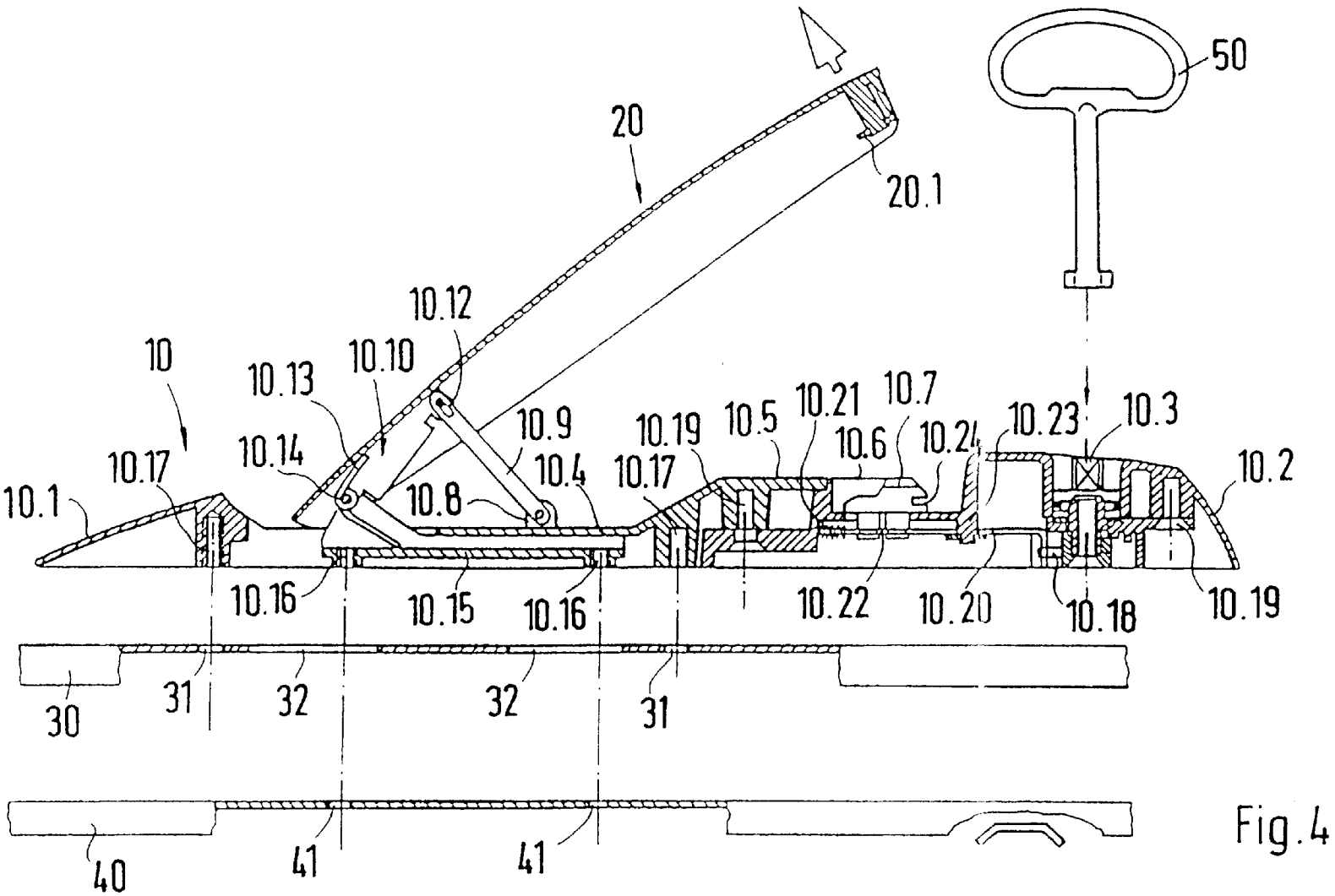
FIG. 4 is a side sectional view showing the sliding rod locking device in accordance with FIGS. 1 to 3 with the handle in the pivoted out position.

To explain the functioning of the sliding rod locking device, particular reference is made to FIG. 4. FIG. 4 shows the sliding rod locking device in a side sectional view. On one end, the handle 20 is connected to an actuating member 10.15 by means of a hinge 10.14. The hinge 10.14 forms a horizontal pivot axis, around which the handle 20 can be pivoted. A restoring spring 10.13 is also arranged in the area of the hinge 10.14. The restoring spring 10.13 maintains the handle 20 under spring-loaded tension, so that it is maintained in its pivoted-out position. Thus, the restoring spring 10.13 acts opposite the inward pivoting direction of the handle 20. A lever 10.9 is provided as a further component of the actuating mechanism 10.10. The lever 10.9 is fastened on a pivot bearing 10.8, which projects out of the handle recess 10.4. The lever 10.9 is connected with the handle 20 on an end remote from the pivot bearing 10.8. The lever 20 has an elongated hole 10.12 for this purpose, in which a bolt of the handle 20 is received.

To move the handle 20 into its pivoted-in position, it is necessary to exert a force on the handle 20. While pivoting the handle 20, the applied force is transferred via the actuating mechanism 10.10 to the actuating member 10.15, so that the actuating member 10.15 can be linearly displaced in the base housing 10.1. In this case the lever 10.9 transfers the applied force, so that large locking forces can be transferred via the actuating member 10.15. The actuating member 10.15 has two retainers 10.16. In the present case, the retainers 10.16 are designed as threaded receivers. By the retainers 10.16, the actuating member 10.15 can be connected to a sliding rod 40 through openings 32 in a cabinet door 30. The sliding rod 40 has two screw receivers 41, into which fastening screws can be inserted and screwed into the retainers 10.16. The openings 32 are designed as elongated holes. Because of a linear displacement of the actuating member 10.15, the sliding rod 40 is also linearly displaced on the back of the cabinet door 30. The sliding rod 40 is designed as a profiled angle section with two profiled legs arranged at right angles with respect to each other. Here, the one profiled leg rests on the back of the cabinet door 30. The second profiled leg rests against an edge of the cabinet door 30. For locking the cabinet door 30 on a switchgear cabinet, the sliding rod 40 has locking elements 42, which cooperate with corresponding counter elements of the switchgear cabinet.

The bolt 10.7 is used for fixing the handle 20 in the pivoted-in position. The bolt 10.7 is held, linearly displaceable, in the bolt receiver 10.6 and has a snap-in receiver 10.24, into which a correspondingly designed snap-in shoulder 20.1 of the handle 20 can snap. The bolt 10.7 is connected to a transfer element 10.20, which is received, linearly displaceable, in the attachment housing 10.2. The transfer element 10.20 is maintained, pre-stressed against a spring 10.21. The spring 10.21 urges the bolt 10.7 in its snapped-in position, as shown in FIG. 4. While pivoting the handle 20 in, the snap-in shoulder 20.1 acts on an inclined deflection face of the bolt 10.7 and thus is displaced opposite the action of the spring. After passing the inclined deflection face, the snap-in shoulder 10.7 snaps into the snap-in receiver 10.24 of the bolt 10.7 and the bolt 10.7 snaps back into its initial position. To release this locking, the transfer element 10.20 is connected to a lock 10.3. The lock 10.3 is received in the attachment housing 10.2. The lock 10.3 can be operated by means of a locking element 50, so that the transfer element 10.20 and the bolt 10.7 are displaced. Thus, the bolt 10.7 releases the handle 20, so that the handle 20 can be moved into its pivoted-out position.

Screw connections 10.19 can be used to fix the attachment housing 10.2 on the base housing 10.1.

Figure 5:
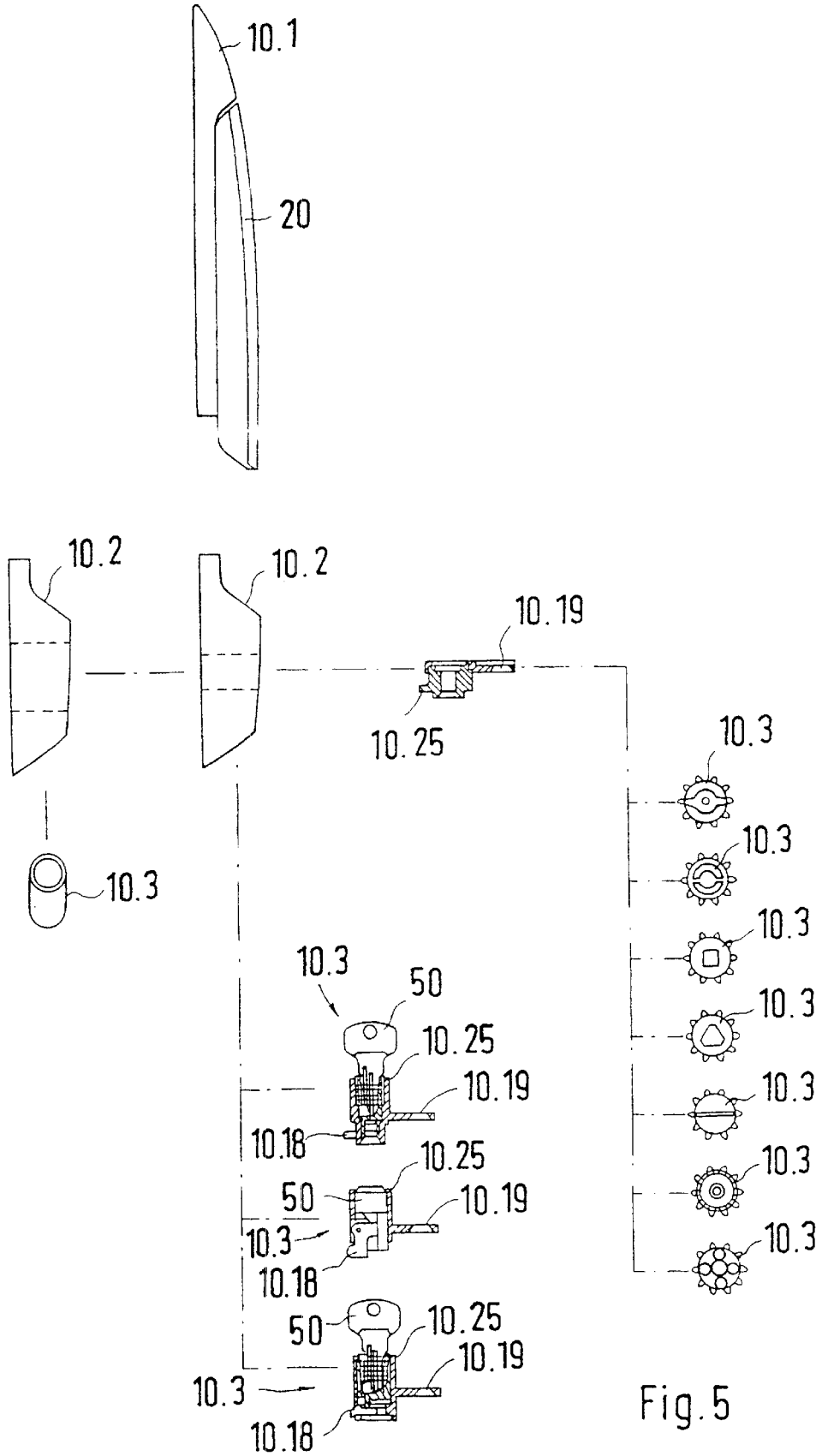
FIG. 5 is an exploded view of the elements of a kit for altering the sliding rod locking device in accordance with FIGS. 1 to 4.

A kit is shown in FIG. 5, by means of which the switchgear cabinet locking device can be adapted to various requirements of the user. Two different attachment housings 10.2 are used for this purpose. In this case, one of the attachment housings 10.2 is used for receiving a special locking cylinder, for example a profiled semi-cylinder. The other attachment housing 10.2 can be individualized by means of different configurations of locks 10.3.

By way of example, the center column in FIG. 5 shows three different types of locks 10.3, which can be housed in specially produced adapter elements 10.25.

Accordingly, a rotating cylinder lock, a pushbutton lock or a combined rotating cylinder and pushbutton lock, for example, can be used as the lock 10.3. The adapter elements 10.25 can be screwed with uniform interfaces to the attachment housing 10.2.

The right column of FIG. 5 shows several different standard locks 10.3, each of which can be operated by means of its own key. These standard locks 10.3 have uniform attachment means, with which they can be fastened to a special adapter element 10.25. Thus, the adapter element 25 can be screwed to the attachment housing 10.2. The adapter element 10.25 can be embodied in two parts. It has a base element, which receives the lock 10.3, and an attachment element, which has the fastening receiver 10.19.

What is claimed is:

1. In a switchgear cabinet locking device for locking a cabinet door of a switchgear cabinet, having a handle (20) to which a locking mechanism is connected via an actuating mechanism (10.10)), wherein the handle (20) is held on a housing (10) attached to an exterior of the cabinet door, wherein the handle (20) is secured in a locked position by a locking device, wherein the housing (10) has a base housing (10.1) for pivotal seating of the handle (20) and an attachment housing (10.2) which can be connected with the base housing (10.1), wherein the attachment housing (10.2) receives a lock (10.3) of the locking device, and in a pivoted-in position the handle (20) is blocked in a pivot direction by the lock (10.3) and is kept interlockingly transversely to the pivot direction on the base housing (10.1), the improvement comprising:

the base housing (10.1) together with the attachment housing (10.2) forming a handle recess (10.4) in which the handle (20) is housed in the locked position, and the handle (20) being pivotably seated vertically with respect to a plane formed by the cabinet door (30).

2. In the switchgear cabinet in accordance with claim 1, wherein the lock (10.3) is received exchangeably in the attachment housing.

3. In the switchgear cabinet in accordance with claim 2, wherein the lock (10.3) is held in an adapter element (10.25) which is connectible with the attachment housing (10.2), and the adapter element (10.25) has a mechanical interface into which different configurations of locks (10.3) can be inserted.

4. In the switchgear cabinet in accordance with claim 3, wherein the lock (10.3) has a transfer device (10.18), which transfers an actuating movement of the lock (10.3) to a linearly displaceable transmission element (10.20) which actuates a bolt (10.7) for blocking the handle (20).

5. The switchgear cabinet in accordance with claim 4, wherein one of a cylinder lock and a pushbutton lock is exchangeably held in the attachment housing (10.2).

6. In the switchgear cabinet in accordance with claim 3, wherein the lock (10.3) and the adapter element (10.25) are completely housed in the attachment housing (2) positioned on the exterior of the cabinet door (30) and remain outside of the door panel.

7. In the switchgear cabinet in accordance with claim 1, wherein the lock (10.3) is held in an adapter element (10.25) which is connectible with the attachment housing (10.2), and the adapter element (10.25) has a mechanical interface into which different configurations of locks (10.3) can be inserted.

8. In the switchgear cabinet in accordance with claim 1, wherein the lock (10.3) has a transfer device (10.18), which transfers an actuating movement of the lock (10.3) to a linearly displaceable transmission element (10.20) which actuates a bolt (10.7) for blocking the handle (20).

9. In the switchgear cabinet in accordance with claim 1, wherein one of a cylinder lock and a pushbutton lock is exchangeably held in the attachment housing (10.2).

10. In the switchgear cabinet in accordance with claim 1, wherein a toggle lever gear converts a pivotal movement of the handle (20) to a linear displacement.

* * * * *